US006589931B2

(12) United States Patent
Ramanan et al.

(10) Patent No.: US 6,589,931 B2
(45) Date of Patent: Jul. 8, 2003

(54) GRANULAR DETERGENT COMPOSITION HAVING AN IMPROVED SOLUBILITY

(75) Inventors: Ganapathysundaram Venkata Ramanan, Kobe (JP); Noe Hidalgo, Kobe (JP); Eric S. J. Robles, Kobe (JP); Kenji Shindo, Kobe (JP)

(73) Assignee: The Procter & Gamble Company, Cincinnatti, OH (US)

( * ) Notice: Subject to any disclaimer, the term of this patent is extended or adjusted under 35 U.S.C. 154(b) by 8 days.

(21) Appl. No.: 09/904,393

(22) Filed: Jul. 12, 2001

(65) Prior Publication Data

US 2003/0050215 A1 Mar. 13, 2003

Related U.S. Application Data

(63) Continuation of application No. PCT/US00/19136, filed on Jul. 13, 2000.

(51) Int. Cl.[7] ..... C11D 1/65; C11D 11/00; C11D 17/06; C11D 1/22

(52) U.S. Cl. ..... 510/441; 510/349; 510/351; 510/495; 510/504

(58) Field of Search ..... 510/349, 495, 510/504, 441, 351

(56) References Cited

U.S. PATENT DOCUMENTS

| | | | | |
|---|---|---|---|---|
| 3,726,813 A | | 4/1973 | Borello | |
| 4,255,294 A | * | 3/1981 | Rudy et al. | 510/331 |
| 4,292,035 A | * | 9/1981 | Battrell | 8/137 |
| 4,751,009 A | * | 6/1988 | Damaso et al. | 510/527 |

FOREIGN PATENT DOCUMENTS

| | | | |
|---|---|---|---|
| GB | 2 158 087 A | | 11/1985 |
| GB | 2203751 A | * | 10/1988 |
| WO | WO 98/17755 A1 | | 4/1998 |
| WO | WO 00/24863 A1 | | 5/2000 |
| WO | WO 01/10993 A1 | | 2/2001 |

* cited by examiner

*Primary Examiner*—Lorna M. Douyon
(74) *Attorney, Agent, or Firm*—Brahm J. Corstanje; Kim William Zerby; Steven W. Miller

(57) ABSTRACT

A granular detergent composition comprising from about 0.01% to about 50% by weight of an anionic sulphonate surfactant, from about 0.01% to about 45% by weight of a hydrotrope, and from about 0.5% to about 5% by weight of a cationic surfactant. The granular detergent composition is substantially free from anionic sulphate surfactant.

9 Claims, No Drawings

GRANULAR DETERGENT COMPOSITION HAVING AN IMPROVED SOLUBILITY

CROSS REFERENCE TO RELATED APPLICATIONS

This application is a continuation of International Application Ser. No. PCT/US00/19136, filed Jul. 13, 2000.

FIELD OF THE INVENTION

The present invention relates to granular detergent compositions and a process for producing the granular detergents. More particularly, the present invention relates to granular detergent compositions having an improved solubility.

BACKGROUND

Recently, there has been considerable interest within the detergent industry for laundry detergents which have the convenience, aesthetics and solubility of liquid laundry detergent products, but retain the cleaning performance and low cost of granular detergent products. There are some problems associated with past granular detergent compositions with regard to aesthetics, solubility and user convenience. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers to purchase. But granular detergents are less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products sometimes experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. This clumping phenomenon can contribute to the incomplete dispensing of detergent in washing machines equipped with dispenser drawers or in other dispensing devices, such as a granulette. In this case, the undesired result is undissolved detergent residue in the dispensing device.

The cause of the aforementioned dissolution problem is generally associated with the "bridging" of a "gel-like" substance between surfactant-containing particles to form undesirable "clumps". However, surfactants are one of the most important ingredients in detergent compositions from cleaning performance standpoint. If reducing the level of surfactants, it may avoid the dissolution problem, but affect the cleaning performance of the product.

Accordingly, the need remains for a granular detergent having an improved solubility with little or no reduction in cleaning performance.

SUMMARY

The present invention is directed to a granular detergent composition comprising from about 0.01% to about 50% by weight of an anionic sulphonate surfactant, from about 0.01% to about 45% by weight of a hydrotrope and from about 0.5% to about 5% by weight of a cationic surfactant. The granular detergent composition is substantially free from an anionic sulphate surfactants.

The granular detergent according to the present invention can provide an improved solubility even in cold water with little of no reduction in cleaning performance. These and other features, aspects, and advantages of the present invention will become evident to those skilled in the art from a reading of the present disclosure with the appended claims.

DETAILED DESCRIPTION

The following is a list of definitions for terms used herein.

"Comprising" means that other steps and other ingredients which do not affect the end result can be added. This term encompasses the terms "consisting of" and "consisting essentially of". All percentages are by weight of total composition unless specifically stated otherwise.

All cited references are incorporated herein by reference in their entireties. Citation of any reference is not an admission regarding any determination as to its availability as prior art to the claimed invention.

The present invention, in its product aspects, is described in detail as follows.

Anionic Sulphonate Surfactant

An anionic sulphonate surfactant is an essential ingredient for the granular detergent of the present invention. A preferable anionic sulphonate surfactant includes the salts (or optionally the acids) of C5–C20 linear or branched alkyl benzene sulphonates, alkyl ester sulphonates, C6–22 primary or secondary alkane sulphonates, C6–C24 olefin sulphonates, sulphonated polycarboxylic acids, alkyl glycerol sulphonates, preferably derived from alcohols derived from tallow or coconut oil, fatty acid glycerol sulphonates, fatty oleyl glycerol sulphonates, and mixtures thereof.

The cation of the anionic sulphonate surfactant may be any appropriate cations such as sodium potassium, hydrogen, ammonium or alcohol amine, preferably, sodium or potassium.

More preferably, the anionic sulphonate surfactant of the present invention is selected from the group consisting of a sodium or potassium salt of C11–13 branched or linear alkyl benzene sulphonates (LAS), C6–22 primary or secondary paraffine sulphonates (PS), C10–18 methyl ester sulphonates (MES), C6–C24 olefin sulphonates (AOS).

The level of the anionic sulphonate surfactants in the granular detergent composition of the present invention is from about 0.01% to about 50%, preferably, from about 20% to about 50%, more preferably, from about 20% to about 45% by weight of the granular detergent.

The granular detergent composition of the present invention is substantially free of anionic sulphate surfactants. "Substantially free of anionic sulphate surfactants" in the present invention means the level of the anionic sulphate surfactants is less than about 0.001%, preferably, less than about 0.0001%, more preferably, 0%.

Hydrotrope

A hydrotrope is an essential ingredient of the granular detergent composition of the present invention. Detergent granules containing linear alkyl benzene sulphonate as surfactant tend to gel in contact with water and the sticky gel around the granules makes the granules stick to each other and form clumps. Not wanting to be limited by theory, it is believed that the hydrotropes modify the phase behavior of the sulphonate surfactant to a less sticky and less viscous phase and solubilize the sulphonate surfactant more quickly and consequently substantially avoid the formation of clumps or residues during the washing process.

Other suitable hydrotropes for use are described in known texts such as Mitijevic, "Surface and Colloid Science" Plenum Press, vol 15(1993), the disclosure of which is incorporated herein by reference.

Preferably, the hydrotropes of the present invention include sulphonic acid, sulphonate salts, polyethylene glycols, polypropylene glycols and mixtures thereof.

The preferable ionized-salts are the alkali metal, alkaline earthmetal, alkyl amine and ammonium salts of the sulphonic acid. More preferable salts are selected from the group consisting of sodium, potassium, monoethanolamine sulphonate and mixtures thereof.

More preferably, the hydrotrope is selected from the group consisting of the sulphonic acids and sulphonates of lower chain aromatic hydrocarbons, polyethylene glycols, polypropylene glycols and mixtures thereof.

Preferable sulphonate salts for the hydrotrope of the present invention are, sodium xylene sulphonates, sodium toluene sulphonates, sodium cumene sulphonates, alkyldiphenyloxide disulphonate having an alkyl group chain length of from C 1 to C 10, and mixtures thereof.

The level of the hydrotrope in the granular detergent composition of the present invention is from about 0.01% to about 45%, preferably, from about 0.1% to about 15%, more preferably, from 0.2% to about 10% by weight of the granular detergent composition.

Cationic Surfactants

Cationic surfactants are an essential ingredient of the granular detergent composition of the present invention. It is believed that cationic surfactants have two benefits for obtaining improved cleaning performance of the granular detergent product: surfactant penetration on soils and hardness tolerance. Anionic sulphonate surfactants have negative charges, while soils are generally positive-charged. As a result, the anionic sulphonate surfactants do not penetrate soils as well as positively charged cationic surfactants. Also, in the washing process, anionic sulphonate surfactants tend to precipitate by forming complexes with hardness ions in water such as calcium and magnesium. Thus, the cleaning performance of the granular detergent compositions are reduced. But, cationic surfactants in combination with anionic sulphonate surfactants, tend to form micelles. As the micelles do not interact with the hardness ions, the anionic sulphonate surfactants do not precipitate. Thus, the cleaning performance of the granular detergent compositions are not reduced.

Preferable cationic surfactants are quaternary ammonium surfactants. Preferable quaternary ammonium surfactants are selected from the group consisting of mono C6–C16, preferably C6–C10 N-alkyl or alkenyl ammonium surfactants, wherein the remaining N positions are substituted by methyl, hydroxyethyl or hydroxypropyl groups. Another preferred cationic surfactant is an C6–C18 alkyl or alkenyl ester of an quaternary ammonium alcohol, such as quaternary chlorine esters.

More preferably, the cationic surfactants have the formula:

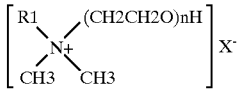

wherein R1 is C8–C18 hydrocarbyl and mixtures thereof, preferably, C8–14 alkyl, more preferably, C8, C10 or C12 alkyl, and X is an anion, preferably, chloride or bromide.

The level of the cationic surfactant is preferably, from about 0.5% to about 5%, preferably, from about 1% to about 5%, by weight of the granular detergent composition.

Process

The granular detergent composition of the present invention is made by a process comprising the step of: (a) mixing the anionic sulphonate surfactant, the hydrotrope and the cationic surfactant; (b) adding other detergent ingredients, and (c) drying the detergent mixture from step (b).

Step (a) is to mix the anionic sulphonate surfactant, hydrotrope and the cationic surfactant, adding water, if necessary. The hydrotrope is added to modify the phase structure of the sulphonate surfactant. Preferably, the anionic sulphonate surfactant is mixed with the cationic surfactant, then the hydrotrope is added because the anionic sulphonate surfactant and the cationic surfactant can form an ion pair complex. The detergent granules preferably contain the anionic sulphonate surfactant and the hydrotrope, in the ratio of the anionic sulphonate surfactant to the hydrotrope from about 50:1 to about 1:1, preferably, from about 25:1 to about 5:1.

In step (b), other detergent ingredients including builders such as carbonates, silicates, zeolites or brighteners are added.

Step (c) preferably includes spray drying of the mixture obtained from steps (a) and (b) to make granules. These granules can be compacted in roll compactors and ground in order to increase the density. Spraying dry can be carried out in conventional spray drying equipment such as a conventional tower as well as other spray drying apparatus. Conventional spray drying equipment may include, for example, a spray-dryer which is provided by Ohkawara. Co., Ltd. (Japan) or Niro Co., Ltd. (Denmark). For drying detergent granules conventional spray drying equipment usually has a height of about 0.5 m to about 30 m and an inside temperature of from about 200° C. to about 500° C.

Examples of the spray-drying process of the present invention are described in U.S. Pat. No. 5,149,455, Jacobs et al, issued Sep. 22, 1992, and U.S. Pat. No. 5,565,442, Del Greco et al, issued Oct. 15, 1996 which are incorporate herein by reference.

The paste of the mixture comprising the anionic sulphonate surfactants, the cationic surfactant and the hydrotrope from step (a) can be agglomerated before step (c). In such agglomeration process, the paste from step (a) is fed into a mixer or densifier (such as Lodige Recycler CB30 and Lodige Recycler KM 300 "Ploughshare") for agglomeration. Preferable agglomeration processes are disclosed in U.S. Pat. No. 5,366,652, Scott et al, issued Nov. 22, 1994 and U.S. Patent, Lisa et al, issued Apr. 28, 1992 which are incorporated herein by reference.

Additional Ingredients/Process

Coating

The granular detergent compositions of the present invention are optionally coated with a water soluble coating material which is selected from the group consisting of anionic sulphonate surfactants, hydrotropes and mixtures thereof.

The granular detergent compositions of the present invention are preferably coated with the water soluble coating material by the following process: (d) passing the detergent granules to a coating mixer; (e) providing the water soluble coating material to the coating mixer; (f) and at least partially coating the granules in the coating mixer to form the coated granular detergent composition.

Optional step (d) is to pass the detergent granules from step (c) of the present invention to a coating mixer such as a high or moderate speed mixer after which an optional low or moderate speed. Alternatively, the coating may be carried out in a single mixer that can be low, moderate or high speed. The particular mixer used in the present process should include pulverizing or grinding and agglomeration tools so that both techniques can be carried forth simultaneously in a single mixer.

Residence times of the mixers will vary depending on the type of mixer and the operating parameters. For a preferred high-speed mixer, the mean residence time is from about 0.1 to 60 seconds, more preferably from about 0.1 to about 30 seconds, even more preferably 0.1 to about 15 seconds. Other preferred conditions of the high-speed mixer include from about 3 to 90 m/s of tip speed, and more preferably from about 10 to 70 m/s of tip speed, and from about 0.005 W/kg to 100 W/kg of power draw, more preferably from about 0.05 W/kg to 80 W/kg of power draw. Preferably, if choppers are used, choppers can be used inside the mixer to break up undesirable oversized particles at an rpm of from about 0 to 5000 rpm, more preferably from about 100 to 3000 rpm. Preferably, the wall temperature is from ambient to about 80° C. and the spacing between the mixer elements and the wall is from about 0.1 cm to 25 cm. Examples of a high-speed mixer having a mean residence time of from about 0.1 to about 60 seconds are Lodige Recycler CB 30™, by Lodige Company, or mixers made by Drais, Schugi, or a similar brand mixer.

For a preferred moderate-speed mixer, the mean residence time is from about 30 to 1800 seconds, more preferably from about 30 to about 1200 seconds, more preferably from about 30 to about 600 seconds. Other preferred conditions of the moderate-speed mixer include from about 0.1 to 30 m/s of tip speed, and more preferably from about 1 to 25 m/s of tip speed, and from about 5 W/kg to 1000 W/kg of power draw, more preferably from about 20 W/kg to 500 W/kg of power draw. Preferably, if choppers are used, choppers can be used inside the mixer to break up undesirable oversized particles at an rpm of from about 0 to 5000 rpm, more preferably from about 100 to 4000 rpm. Preferably, the wall temperature is from about −20° C. to about 80° C. and the spacing between the mixer elements and the wall is from about 0.1 cm to 25 cm. Examples of a moderate-speed mixer having a mean residence time of from about 30 to about 1800 seconds are Lodige Recycler KM "Ploughshare" 300™ and 600™, by Lodige Company, the Drais K-T 160™ mixer, or mixers made by Fukae. The Lodige KM "Ploughshare" 600™ moderate-speed mixer is a particularly preferred mixer, which comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. In a preferred mixer, the grinding or pulverizing is accomplished by cutters, generally smaller in size that the rotating shaft, which preferably operate at about 3600 rpm.

For a preferred low-speed mixer, the mean residence time is from about 30 seconds to about 1800 seconds, more preferably from about 30 seconds to about 1200 seconds, and even more preferably from about 30 seconds to about 600 seconds. The tip speed is preferably from about 0.1 m/s to about 10 m/s, more preferably from about 0.2 m/s to about 7 m/s, and even more preferably from about 0.2 m/s to about 3.5 m/s. Examples of preferred low-speed mixers include rotating bowl agglomerators, drum agglomerators, pan agglomerators, fluid bed granulators, and extruders. An example of an extruder is a multiple-screw extruder by Wemer-Pfliedder (Germany).

In one preferred embodiment it has been found that the step (c) can be successfully completed, under the process parameters described, in a Lodige KM™ (Ploughshare) moderate speed mixer, Lodige CB™ high speed mixer, or mixers made by Fukae, Drais, Schugi or similar brand mixer. The Lodige KM™ (Ploughshare) moderate speed mixer, which is a preferred mixer for use in the present invention, comprises a horizontal, hollow static cylinder having a centrally mounted rotating shaft around which several plough-shaped blades are attached. Other mixers similar in nature which are suitable for use in the process include the Lodige Ploughshare™ mixer and the Drais® K-T 160 mixer.

Optional step (e) is to provide the water soluble coating material to the coating mixer. The water soluble coating material is selected from the group consisting of anionic sulphonate surfactants, hydrotropes and mixtures thereof. As explained, anionic sulphonate surfactants and hydrotropes are added in step (a). But additional anionic sulphonate surfactants and hydrotropes can be added during this step as well. Preferably, the water soluble coating material is a mixture of the anionic sulphonate surfactant and the hydrotrope in a ratio of the anionic sulphonate to the hydrotrope of from about 95:5 to about 5:95, more preferably, from about 50:1 to about 1:1.

Optional step (f) is at least partially to coat the granules from step (e) and to obtain the granular detergent compositions of the present invention.

Particle Size

The granular detergent compositions of the present invention preferably comprise at least about 50% by weight of granules having a geometric mean particle diameter of from about 400 microns to about 1500 microns and preferably have a geometric standard deviation of from about 1 to about 2. Preferably the geometric standard deviation is from about 1.0 to about 1.7, preferably from about 1.0 to about 1.4. The granular detergent composition resulting from the processes may comprise undersized or fine particles, wherein "fine particles" are defined as particles that have a geometric mean particle diameter that is less than about 1.65 standard deviations below the chosen geometric mean particle diameter of the granular detergent composition at a given geometric standard deviation. Oversized or large particles may also exist wherein "large particles" are defined as particles that have a geometric mean particle diameter that is greater than about 1.65 standard deviations above the chosen geometric mean particle diameter of the granular detergent composition at a given geometric standard deviation. The fine particles are preferably separated from the granular detergent composition and returned to the process by adding them to at least one of the mixers and/or the fluid bed dryer as described in detail below. Likewise, the large particles are preferably separated from the granular detergent composition and then fed to a grinder where their geometric mean particle diameter is reduced. After the geometric mean particle diameter of the large particles is reduced, the large particles are returned to the process by adding them to at least one of the mixers and/or the fluid bed dryer.

Other Ingredients

The granular detergent composition of the present invention can further contain a wide variety of ingredients, including but not limited to optical brighteners, pigments or dyes, chelants, nonionic surfactants, pH control agents, detergency co-builders, fillers and mixtures of these materials. Particularly preferred are pigments or dyes such as titanium dioxide, bluing agents such as copper sulfate, zinc thiosulfate and Ultramarine blue, Sparkle enhancers such as mica flake, fillers such as sodium carbonate and sodium sulfate and co-builders such as citrates and nonionic surfactants.

The granular detergent composition can also contain bleaching agents, bleach activators, enzymes, perfumes, non-coated detergent particles, and various other ingredients to produce a fully formulated detergent composition.

These suitable ingredients are disclosed and exemplified in U.S. Pat. No. 5,756,444, issued May 26, 1998 to Scott et al, in U.S. Pat. No. 5,478,503, issued Dec. 26, 1995 to Ronald. The entire disclosure of these references are incorporated herein by reference.

The aspects and embodiments of the invention set forth in this document have many advantages, including an improved solubility with little or no reduction in cleaning performance.

The following examples further describe and demonstrate the preferred embodiments within the scope of the present invention. The examples are given solely for the purpose of illustration, and are not to be construed as limitations of the present invention since many variations thereof are possible without departing from its spirit and scope.

EXAMPLES

Examples 1–8

| | weight % | | | | | | | |
|---|---|---|---|---|---|---|---|---|
| | 1 | 2 | 3 | 4 | 5 | 6 | 7 | 8 |
| LAS* | 30 | 30 | 30 | 20 | 25 | 25 | 25 | 25 |
| SXS** | 4 | 2 | 1 | 4 | 2 | 1 | 3 | 3 |
| Polyethylene glycol | 0.1 | — | 0.1 | 0.1 | 0.5 | 0.1 | 0.5 | 0.5 |
| CocoK3 | 2 | 2 | 2 | 2 | 2 | 1 | 1 | 1 |
| Brighteners | 0.35 | 0.35 | 0.35 | 0.35 | 0.35 | 0.35 | 0.35 | 0.35 |
| Sodium carbonate | 20 | 20 | 20 | 20 | 30 | 20 | 30 | 30 |
| Zeolite A | 5 | 5 | 5 | 10 | 5 | 5 | 10 | 10 |
| Acrylic-Maleic acid copolymer | 10 | 10 | 10 | 10 | 10 | 10 | 10 | 10 |
| Silicate | 15 | 15 | 15 | 15 | 0 | 15 | 0 | 0 |
| Coating material | | | | | | | | |
| LAS | — | 6 | — | 6 | 6 | 6 | 6 | 6 |
| SXS | — | — | 3 | 2 | 1 | 0.5 | 0.5 | — |
| Polyethylene glycol | — | — | — | — | — | — | — | 3 |
| Sodium percarbonate | 3.2 | 3.2 | 3.2 | 3.2 | 3.2 | 3.2 | 3.2 | 3.2 |
| NOBS*** | 2.7 | 2.7 | 2.7 | 2.7 | 2.7 | 2.7 | 2.7 | 2.7 |
| Perfume | 0.2 | 0.2 | 0.2 | 0.2 | 0.2 | 0.2 | 0.2 | 0.2 |
| Protease | 0.5 | 0.5 | 0.5 | 0.5 | 0.5 | 0.5 | 0.5 | 0.5 |
| Minors | | | | up to 100% | | | | |

*40% Linear Alkylbenzene Sulphonate paste
**20% Sodium Xylene Sulphonate solution
***Sodium nonanoyloxybenzene Sulphonate (bleach activator)

What is claimed is:

1. A granular detergent composition comprising:

(a) from about 0.01% to about 50% by weight of an anionic suiphonate suifactant;

(b) from about 0.01% to about 45% by weight of a hydrotrope; and (c) from about 0.5% to about 5% by weight of a cationic surfactant, wherein the granular detergent composition is substantially free of anionic sulphate surfactants, and wherein the detergent composition is coated with a water soluble coating material selected from the group consisting of anionic suiphonate surfactants, hydrotropes, and mixtures thereof.

2. The granular detergent composition according to claim 1, wherein the detergent composition comprises from about 20% to about 50% by weight of an anionic suiphonate surfactant.

3. The granular detergent composition according to claim 1, wherein the anionic sulphonate surfactant is selected from the group consisting of sodium or potassium salt of C11–13 branched or linear alkyl benzene sulphonates, C6–22 primary or secondary paraffin sulphonates, C10–18 methyl ester sulphonates, C6–24 olefin sulphonates, and mixtures thereof.

4. The granular detergent composition according to claim 1, wherein the hydrotrope is selected from the group consisting of polyethylene glycols, polypropylene glycols, sulphonate salts and mixtures thereof.

5. The granular detergent composition according to claim 1, wherein the hydrotrope is selected from the group consisting of sodium xylene sulphonate, sodium toluene suiphonate, sodium cumene suiphonate, alkyldiphenyloxide disuiphonate having an alkyl group chain length of from C1 to C10 and mixtures thereof.

6. The granular detergent composition according to claim 1, wherein the water soluble coating material is a mixture of an anionic sulphonate surfactant and a hydrotrope in a ratio of anionic sulphonate surfactant to hydrotrope of from about 95:5 to about 5:95.

7. The granular detergent composition according to claim 1, wherein the detergent composition has a geometric mean particle diameter of from about 400 microns to about 1500 microns with a geometric standard deviation of from about 1 to about 2.

8. A process for preparing a granular detergent composition having from about 0.01% to about 50% by weight of an anionic sulphonate surfactant, from about 0.01% to about 45% by weight of a hydrotrope, and from about 0.5% to about 5% by weight of a cationic surfactant, wherein the granular detergent composition is substantially free of anionic sulphate surfactants, and wherein the detergent composition is coated with a water soluble coating material selected from the group consisting of anionic suiphonate surfactants, hydrotropes, and mixtures thereof; the process comprising the steps of:

(a) mixing the anionic sulphonate surfactant, the hydrotrope and the cationic surfactant;

(b) drying the detergent mixture thereby forming detergent granules;

(c) passing the detergent granules to a coating mixer;

(d) providing the water soluble coating material to a coating mixer; and (e) at least partially coating the granules in the coating mixer to form the coated detergent granular composition.

9. The process of claim 8, further including after step (a) and before step (b), adding other detergent ingredients selected from the group consisting of pigments, dyes, chelants, pH control agents, fillers, builders, brighteners, bleaching agents, bleach activators, enzymes, and perfumes.

* * * * *